United States Patent [19]

DeLong

[11] Patent Number: 4,570,423

[45] Date of Patent: Feb. 18, 1986

[54] TREE BALL WRAPPING DEVICE

[76] Inventor: Russell DeLong, R.D. #3, Box 280, Bernville, Pa. 19506

[21] Appl. No.: 680,386

[22] Filed: Dec. 11, 1984

[51] Int. Cl.[4] ..... B65B 47/00

[52] U.S. Cl. ..... 53/578; 53/176; 53/219; 53/220; 53/390; 53/594; 47/74; 248/97

[58] Field of Search ..... 53/176, 219, 220, 390, 53/464, 578, 582, 594; 47/74; 248/97

[56] References Cited

U.S. PATENT DOCUMENTS 3,782,773 1/1974 Mason ..... 47/76

4,287,840 9/1981 Weidner ..... 53/390

*Primary Examiner*—John Sipos

*Attorney, Agent, or Firm*—Leonard M. Quittner

[57] ABSTRACT

A tree ball tying apparatus is disclosed comprising a tripartile inverted, truncated conically shaped holder whose included angle is less than 60° and is made of sheet metal attached to a stand by its rearmost part. The two forward parts are hinged, latchable doors which swing open or may be closed and latched in the conical shape. Cordage is woven around hooks and pins in the peripheries of the cone's base and truncation to form a sling over which is placed a degradable material such as burlap. A tree, whose ball is conically cut with typically a 60° included angle, is removed from the ground and installed ball first onto the burlap and sling and set down sling and burlap first into the holder whose included angle is less than that of the ball thereby holding it above the truncation. Thereafter the burlap is folded around the tree trunk and tied with the loose ends of the sling and the tree removed from the holder with its ball wrapped and tied.

5 Claims, 9 Drawing Figures

FIG. 3
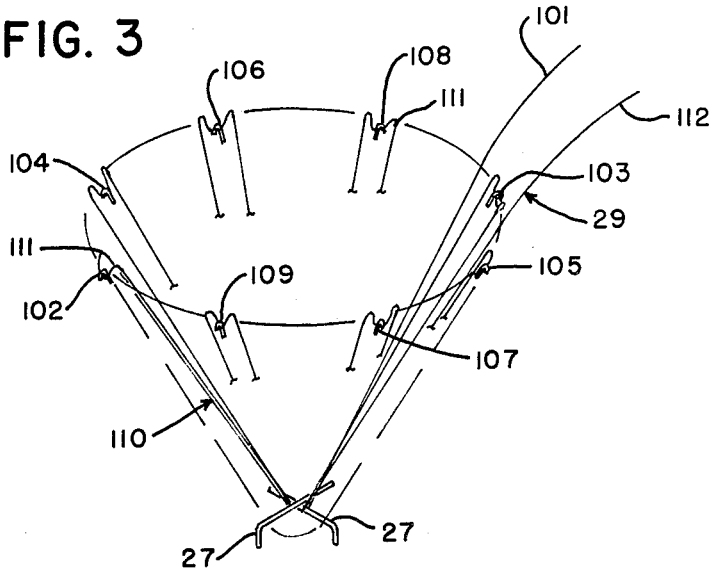
FIG. 4
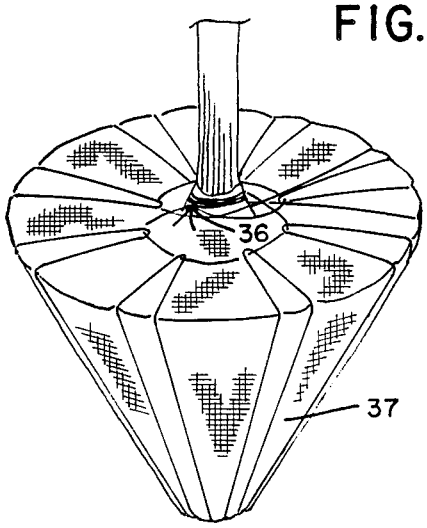
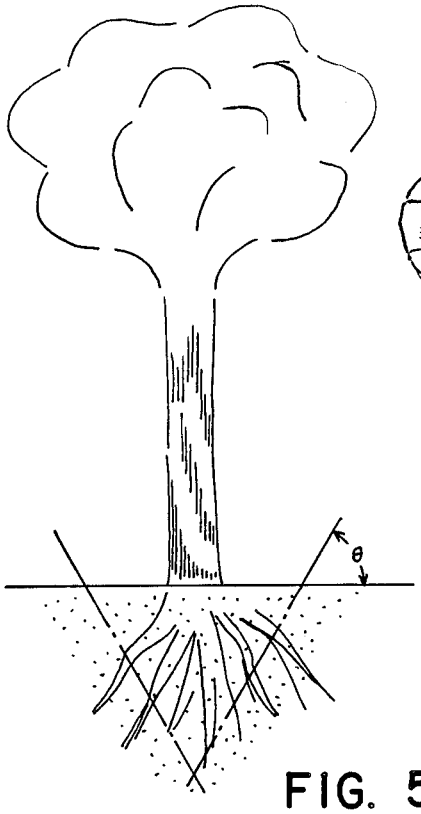
FIG. 5

TREE BALL WRAPPING DEVICE

FEDERALLY-SPONSORED RIGHTS

The invention herein was made without any Federal sponsorship or contribution.

CROSS-REFERENCE

There are no cross-references to, nor are there any, related applications.

BACKGROUND OF THE INVENTION

1. The Field of the Invention

The field of the invention relates to an improved tree ball wrapping device for enwrapping the root ball of a tree which has been removed from the ground manually or by automatic tree removal means as are found in commercial nurseries. The ball is wrapped in protective, bio-degradable cloth material such as burlap to protect and keep damp the roots during transport and replanting or when holding above ground.

2. Description of the Prior Art

The prior art is best demonstrated by reference to tree removal devices such as that supplied by Veemeer Manufacturing Co., of Pella, IA 50219, Caretree Systems, Worthington, OH 43085, and others.

A tree is removed from the ground for transplanting by carrying with it its root system. If removed manually, the root system tends to encapsulate considerable earth when the tree is lifted. This is represented by a typically bulky spheroidal shaped network of roots and earth from which the trade term "ball" is derived.

Modern practice takes advantage of the fact that tree root systems grow downward centrally in more or less conical form, making the digging of a spheroidally shaped ball unnecessary and inefficient, requiring as it does considerably more weight of earth to remove and a considerably larger hole for transplanting. Since this is so, the tree is susceptible to being dug by straight-forward conical cuts forming an included angle of typically 60° and lifted from the ground automatically. The device which accomplishes such a thing has a plurality of shovel-like diggers mounted to hydraulically driven rams which are propelled to meet each other below ground surface, to form a cone-shaped "ball" and thereby enabling rapid lifting and removal of a tree from the ground with its root system essentially intact in the conical mass. Wrapping the roots in, for example, burlap is left to the operator who must disgorge the tree from the ram driven shovels by retracting them over a burlap sheet set flat upon the gound. The tree thereafter becomes positionally unstable on account of the cone. The ball is then manually wrapped in the burlap which is tied to and around it and the tree trunk. Because of the instability, tying is a haphazard process at best and frequently proves to be destructive of the root system. This leads to the premature death of the tree and its ultimate replacement by the nursery.

Your inventor contends that there is no known systematic means currently available in the art comparable to the present invention in which a tree ball of the type described can be efficiently and rapidly enwrapped and tied without damage to the root system.

SUMMARY OF THE INVENTION

The invention described herein is summarized as a tripartile inverted, hollow truncated conically shaped tree ball holder assembly having an included angle less than 60° and is made of sheet metal. The assembly has an inner surface and an outer surface and an upper, circular major periphery in a plane at a right angle to the cone's central axis and a lower, elipsoidal minor periphery in a plane inclined toward the cone's central axis at an angle of typically 10°. The holder is attached to a stand at its rearmost, fixed part such that the assembly is held in an upright position, the cone's central axis being perpendicular to the stand's base. The two forwardmost parts form doors which are hinged to the rear part such that their weight will cause them, when loose, to swing outwardly and downwardly thereby exposing to access the inner surface of the cone. The doors may be swung closed and locked in the cone shape with a latching bar.

In the closed position, along the major periphery on the cone's outer surface, are spaced a multiplicity of tie cord receiving hooks which receive cord to tie up the ball. Disposed in each forward part through an aperature contained therein near the minor periphery is an "L" shaped tie pin such that the pin will cross over within the cone another pin set in the adjacent door, each pin being held in an aperature in the rear part near the minor periphery a defined distance apart from the other such that the pins form a right angle when inserted.

A tie cord is laced loosely around the hooks and the tie pins in a loop and sling forming order. A burlap sheet is draped over the cord in the hollow and a tree with a conical ball is set down therein pushing the sling and burlap down into the hollow. Since the holder's included angle is less than that of the ball, the ball is prevented from bottoming out and will be held at a defined distance above the minor periphery and the tie pins. The tie pins may then be slidably removed freeing the tie cord sling portion to move up around the burlap. The free upper, exposed edges of the burlap are folded toward each other and tree trunk thereby exposing the cord portion looped around the hooks. Thereafter, free ends of the cord are run through the loops as they are removed from the hooks and made taut to form and enclosed sling, the free ends then being tied snugly around the trunk to secure the ball. The latching bar is slidably removed from the doors which swing open to reveal a tied ball. The burlap and cord will be found to have enwrapped the ball in a snug and orderly manner.

One skilled in the art will immediately realize that even a hand dug ball can also be installed in the holder to take advantage of its benefits with a certain amount of shaping.

An object of the invention is to hold and enwrap a tree ball of a tree dug from the ground without damage to the tree's root system.

A further object of the invention is to provide a rapid stable means of holding a conical tree ball in a stable position until it is tied.

Another object of the invention is to provide an orderly means to tie the wrapping material to the ball without damage thereto.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein 9 figures are shown on 3 sheets. The numbers shown on the drawings for the various parts of the invention are consistent throughout so that a number indicating a part in one drawing will indicate the same part in another drawing.

FIG. 3 shows a skeletal view of the holder and the loop and sling forming order in which the cord is woven around the loop hooks and tie pins.

FIG. 4 shows a tree ball wrapped and ready for transplanting.

FIG. 5 shows a schematic view of a tree and root system to be cut in a conical shape with a 60° included angle.

DESCRIPTION OF THE PREFERRED EMBODIMENT

Figure 1:
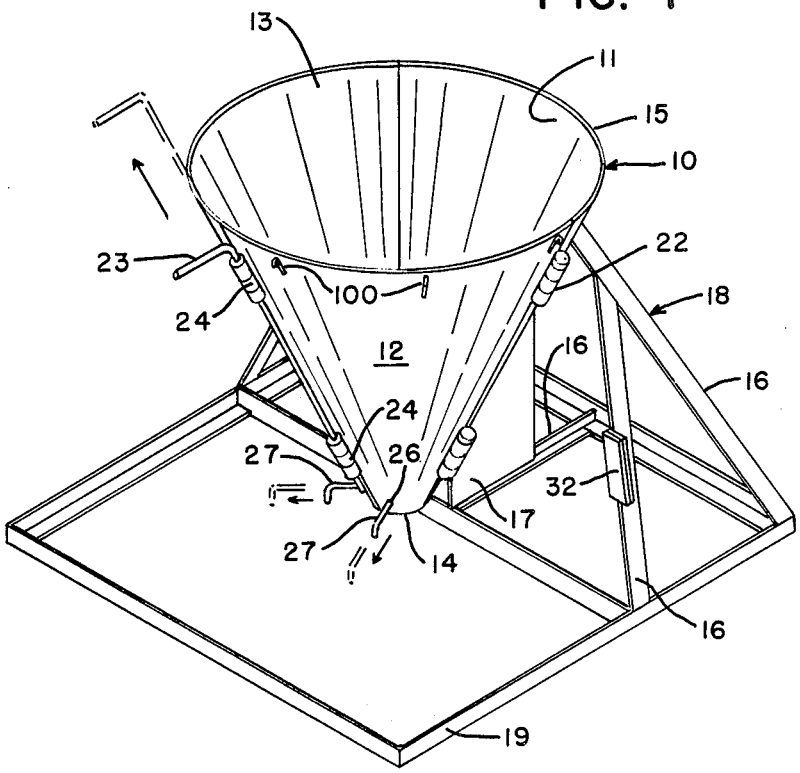
FIG. 1 shows a holder assembly in the closed and latched position on its stand.
Figure 2:
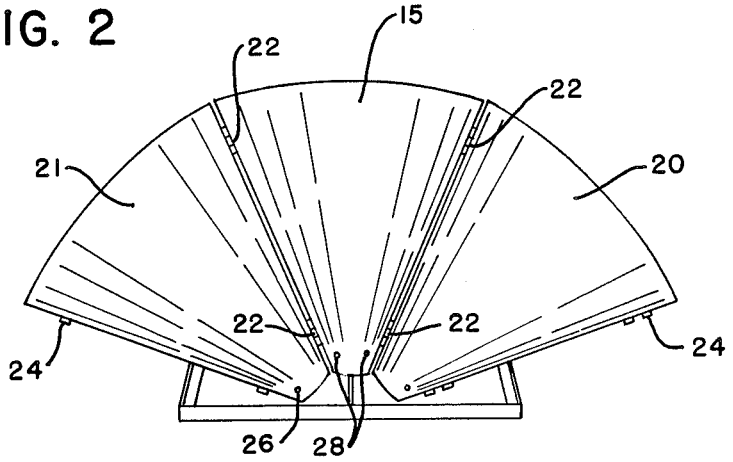
FIG. 2 shows a front view of the holder assembly with a tree removed.
Figure 6:
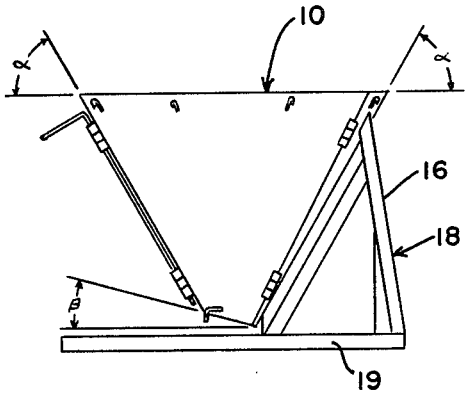
FIG. 6 shows a side view of the closed holder on the stand with the truncated angle exhibited.

The preferred embodiment is described as comprising a tripartile, hollow, inverted truncated conically shaped tree holder assembly (10) made of metal, the cone having an included angle of less than 60° (alpha) and having an inner surface (11), an outer surface (12) and having an upper, circular major periphery (13) in a plane at a right angle to the central axis of the cone and a lower, elipsoidal minor periphery (14) in a plane at a truncating angle (theta) of typically 10° to the central axis. The holder is attached at its fixed, rearmost part (15) by struts (16) and a stiffener (17) to an angle iron stand (18) with a base (19) such that the holder is held in an upright position, the cone's central axis being perpendicular to the base. The two forward most parts (20, 21) form doors which are hinged (22) to the rear part such that the doors will swing outwardly and downwardly (FIG. 2) of their own weight thereby exposing to access the inner surface of the holder and which may be swung closed and locked in the conical shape (FIG. 1) with a slidably installed latching bar (23) which is inserted through mating hinge pieces (24) which are matably attached to adjacent edges of the doors.

Around and near the major periphery are an equally spaced multiplicity of tie cord receiving hooks (100) which receive a tie cord which is woven therearound and around tie pins (27) to form a sling and tie a burlap wrapper (30) around a tree ball (25), as is more particularly described hereinafter. Disposed in each door near its minor periphery is a tie pin receiving aperture (26) which receives an "L" shaped tie pin (27) such that the pin will cross another, one over the other, which is inserted similarly in its door. Both are held by aperatures (28) in the rear part near the minor periphery thereof spaced a defined distance apart such that the fully installed pins form a right angle with each other.

Prior to receiving a tree ball a tie cord (29) is loosely woven around the hooks and pins in a certain order by taking and pulling a free end (101) thereof under the tie pins inside the cone and up and around a first hook (102) then back down under the tie pins, across and up and around an opposing second hook (103), then back down under the tie pins, across and up and around a third opposing hook (104), then down under the tie pins again and up to another, fourth opposing hook (105) and so on. In this way opposing hooks (106 to 107 to 108 to 109) in sequence may, by the identical procedure, be utilized to shape a tie cord sling (110) with loops (111), termination with the tie cord's opposite free end (112).

Figure 7:
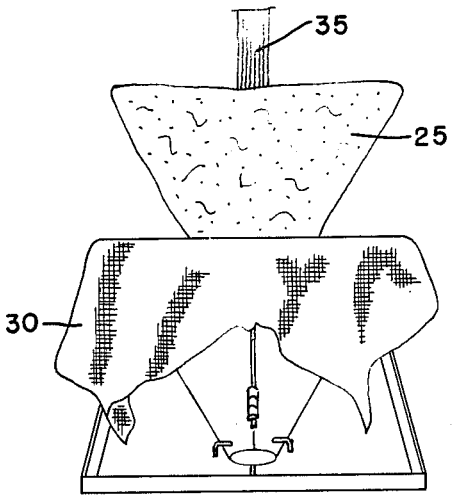
FIG. 7 shows a side view of the holder draped with burlap and a tree ball entering the holder.
Figure 8:
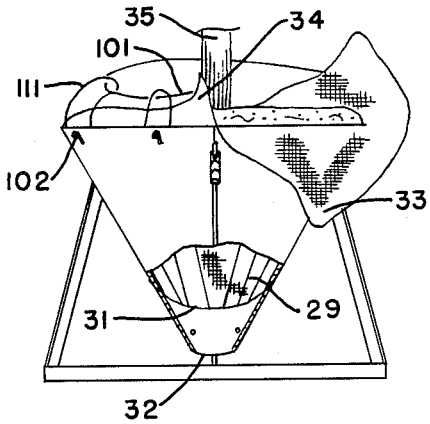
FIG. 8 shows side view of the holder with the tree ball seated in the holder with burlap folding and cordage looping.
Figure 9:
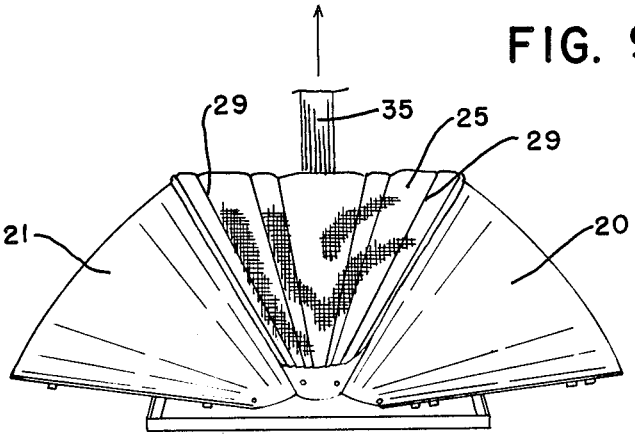
FIG. 9 shows a side view of the open holder with an enwrapped and tied ball ready for removal.

The burlap wrapper is draped over the cord sling in the hollow and the tree ball is set down into the hollow (FIG. 7) over them, stopping short of the minor periphery because of the difference in the included angles of the cones of the ball and holder. The central portion (31) of the burlap is pushed toward the truncation (32) such that it does not touch the tie pins. The free edges (33) of the burlap are folded (34) toward each other and the tree trunk (35) thereby exposing the loops. Thereafter, the free ends of the tie cord are run through the loops as they are freed from the hooks and made taut purse-closingly to tie (36) snugly around the tree trunk. The burlap and cord will thereby enwrap the ball (FIG. 8). The tie pins are slidably removed from the holder as is the latching bar. The doors are swung open and the enwrapped tied ball (37) is removed.

Since many modifications, variations and changes in detail may be made to the presently described embodiment, it is intended that all matter in the foregoing description and accompanying drawings be interpreted as illustrative and not by way of limitation.

What claimed is:

1. A tree ball wrapping apparatus comprising a tripartile truncated conical shaped holder assembly of metal having an included angle of less than 60° and having a major circular periphery in a plane at a right angle to the cone's central axis and a minor elipsoidal periphery in a plane inclinded toward the central axis at a truncating angle and having a first rearmost fixed part which is attached to a base such that the holder is held upright and a second and a third part which form hinged doors attached by hinges to the fixed part and whose free adjacent edges are equipped with a latching bar receiving means such that the doors may be latched together by a slidably installed latching bar to form the cone and having installed equally spaced apart on the holder's outer surface along the major periphery of each part a multiplicity of tie-cord receiving hooks and installed in each door centrally near the minor periphery a tie pin receiving aperature which has installed therein slidably an "L" shaped tie pin such that each tie pin crosses one over the other interiorly in the holder and is held by an aperature spaced a defined distance apart from another aperature in the fixed part near the minor periphery thereof such that the tie pins cross each other at right angles and having a tie cord with a free end which is woven around the hooks and tie pins to form a sling over which is installed a sheet of biodegradable material which enwraps a conical tree ball as it is set down over the sheet and sling into the holder thereby permitting the material to be tied snugly around the ball when it is removed from the holder.

2. A tree ball apparatus as in claim 1 in which the cone's included angle is between 54° and 59°.

3. A tree ball apparatus as in claim 2 in which the cone's included angle is 56°.

4. A tree ball apparatus as in claim 2 in which the trunacating angle is between 5° and 15°.

5. A tree ball apparatus as in claim 4 in which the truncating angle is 10°.

* * * * *